US006328620B1

(12) United States Patent
Hu

(10) Patent No.: US 6,328,620 B1
(45) Date of Patent: Dec. 11, 2001

(54) APPARATUS AND METHOD FOR FORMING COLD-CATHODE FIELD EMISSION DISPLAYS

(75) Inventor: Yongjun Jeff Hu, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/205,197

(22) Filed: Dec. 4, 1998

(51) Int. Cl.[7] ..... H01J 9/04
(52) U.S. Cl. ..... 445/50; 445/51
(58) Field of Search ..... 445/24, 50, 49, 445/51; 313/336, 331, 309

(56) References Cited

U.S. PATENT DOCUMENTS

| | | | | |
|---|---|---|---|---|
| 4,940,916 | | 7/1990 | Borel et al. . | |
| 5,210,472 | | 5/1993 | Casper et al. . | |
| 5,401,676 | * | 3/1995 | Lee | 313/311 |
| 5,644,195 | | 7/1997 | Browning . | |
| 5,656,886 | | 8/1997 | Westphal et al. . | |
| 5,726,524 | * | 3/1998 | Debe | 313/309 |
| 5,754,149 | | 5/1998 | Browning et al. . | |
| 5,807,154 | | 9/1998 | Watkins . | |
| 6,086,442 | * | 6/2000 | Sandhu et al. | 445/24 |
| 6,113,451 | * | 9/2000 | Hobart et al. | 445/50 |

* cited by examiner

*Primary Examiner*—Nimeshkumar D. Patel
*Assistant Examiner*—Todd Reed Hopper
(74) *Attorney, Agent, or Firm*—Dickstein Shapiro Morin & Oshinsky LLP

(57) ABSTRACT

An emission site for a large area passive matrix cold cathode field emission display having an emission tip with a sharp profile is disclosed. A metallic film formed of iridium silicide (IrSi) is used to coat the tip. By using IrSi the tips of the emission sites can be formed at low temperatures. In addition, IrSi is a fine grain material that maintains a sharp profile and can be formed in a layer as thin as 100 Å.

28 Claims, 3 Drawing Sheets

APPARATUS AND METHOD FOR FORMING COLD-CATHODE FIELD EMISSION DISPLAYS

BACKGROUND OF THE INVENTION

1. Field of the Invention

The present invention relates generally to a technique to improve emitter tip quality on large area passive matrix cold cathode field emission displays and, in particular, to enhance electron emission from the emitter tips.

2. Description of Related Art

Cathode ray tube (CRT) displays are commonly used in display devices such as televisions and desk-top computer screens. CRT displays operate as a result of a scanning electron beam from an electron gun striking phosphors resident on a distant screen. The electrons increase the energy level of the phosphors. When the phosphors return to their original energy level, they release photons which are transmitted through the display screen (normally glass) forming a visual image to a person looking at the screen. A colored CRT display utilizes an array of display pixels wherein each individual display pixel is comprised of a trio of color generating phosphors (that is, each pixel is split into three colored parts, which alone or in combination create colors when activated). Color images are created by exciting the appropriate colored phosphors.

Flat panel displays are becoming increasingly popular to display the information of computer systems and other devices. Typically, flat panel displays are lighter and utilize less power than conventional CRT display devices.

One type of flat panel display is known as a cold cathode field emission display (FED). Cold cathode FED's are similar to CRT displays in that they use electrons to illuminate a cathodoluminescent screen. The electron gun is replaced with numerous (at least one per display pixel) emitter sites. When activated by a high voltage, the emitter sites release electrons which strike the display screen's phosphor coating.

FED technology utilizes a matrix addressable array of pointed, thin film, cold field emission cathodes in combination with a phosphor luminescent screen. U.S. Pat. No. 4,940,916, which is hereby incorporated by reference in its entirety, discloses an electron source, with micropoint emissive cathodes, and a display by use of cathodoluminescent excited by field emission from the electron source. Each cathode has an electrically conductive layer, a continuous resistive layer on the conductive layer and a patterned array of a plurality of micropoints. The display includes a cathodoluminescent anode facing the source.

A further example of FED technology can be found in U.S. Pat. No. 5,210,472, the disclosure of which is incorporated herein by reference. An emissive flat panel display operates on the principles of cathodoluminescent phosphors excited by cold cathode field emission electrons. A face plate having a cathodoluminescent phosphor coating receives patterned electron bombardment from an opposing base plate thereby providing a light image which can be seen by a viewer. The face plate is separated from the base plate by a vacuum gap and, in some embodiments, the two plates are prevented from collapsing together by physical standoffs or spacers fixed between them.

The base plate of a field emission display is comprised of arrays of emission sites (emitters) which are typically sharp-tipped pyramids that produce electron emission in the presence of an intense electric field. An extraction grid within a face plate of the field emission display is disposed above the sharp emitters and provides the intense positive voltage for the electric field and a mechanism for addressing and activating the generation of electron beams from those sites. Varying the charge which is delivered to the phosphor in a given pixel from an emission array will vary the light output (brightness) of the pixel associated with it. Two techniques for varying the charge delivered by an emission array are to either vary the time period of activation (duty cycle) or to vary the emission current.

The sharp pyramids that make up the arrays of emission sites are typically formed of silicon (Si) and are covered with a metallic film. The emission sites need to maintain a sharp profile to emit electrons in a reliable and controlled manner. Accordingly, there is a desire and need for an emission site and a method of forming an emission site having a tip which is able to maintain a sharp profile.

Producing an emission site having a sharp profile is difficult due to the nature of the silicon-to-metal interface and the grain size of the metal used to coat the pyramids of silicon. Accordingly, there is a desire and need to produce emission sites having a tip capable of maintaining a sharp profile in an easy manner.

SUMMARY OF THE INVENTION

The present invention provides emission tips and a method of constructing emission tips for use in large area passive matrix cold cathode field emission flat panel display devices which are capable of maintaining a sharp profile.

The above and other features and advantages of the invention are achieved by providing an emission site having a tip with a sharp profile. A metallic film formed of iridium silicide (IrSi) is used to coat the tip. By using IrSi the tips of the emission sites can be formed at low temperatures. In addition, IrSi is a fine grain material that maintains a sharp profile and can be formed in a layer as thin as 100 Å.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
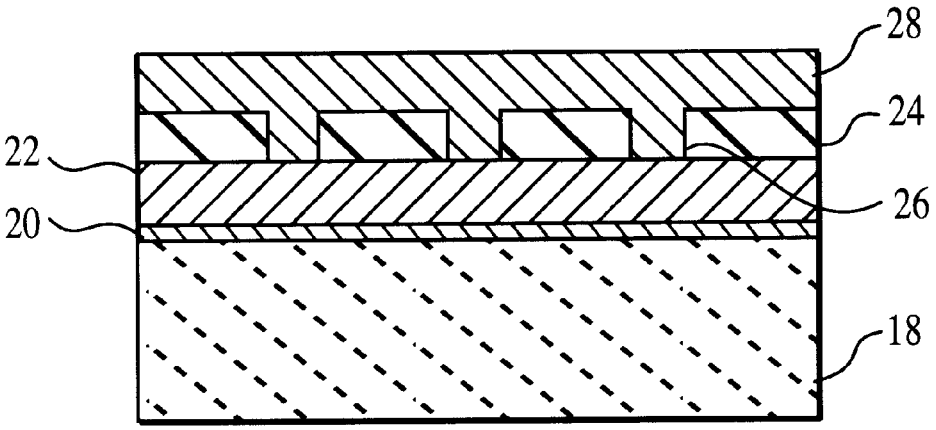
FIG. 1 illustrates a section of a field emission display substrate during a one processing step in accordance with the present invention.

With reference to FIG. 1, the processing method of the present invention starts by providing a substrate 18, such as glass, with an insulating layer 20, such as deposited silicon oxide ($SiO_2$). Suitable substrates for the present invention would include sodalime glass, and borosilicate glass, such as Corning 7059. A resistive layer 22, such as amorphous, microcrystalline, or polycrystalline silicon, is deposited on the insulating layer 20 forming a resistive layer for a passive matrix field emission display device. Resistive layer 22 may be formed from a thin silicon film such as amorphous, microcrystalline, or polycrystalline silicon, or any other semiconductor thin film with the desired electrical characteristics, by any conventional process. The resistive layer 22 is patterned as a series of strips that will make up columns of the passive matrix field emission display device.

A protective layer 24, such as a layer of dielectric material, is placed on the resistive layer 22. The protective layer can be formed, for example, from $SiO_2$, silicon nitrate ($Si_3N_4$), or oxynitride. The protective layer 24 is subsequently etched to form a patterned array of holes 26 reaching to the resistive layer 22. The protective layer 24 can be etched with either wet or dry etchants that are commonly used to etch $SiO_2$, $Si_3N_4$, or oxynitride.

A layer of cathode material 28, preferably p-doped amorphous silicon is deposited directly on top of the protective layer 24 and contacts the resistive layer 22 through holes 26 forming conductive bases 30. Alternatively, the cathode material 28 can be formed from microcrystalline, or polycrystalline silicon or other semiconductor thin film with the desired electrical properties. If another wafer is bonded to the substrate 18 then the cathode material 28 can be monocrystalline Si.

Figure 2:
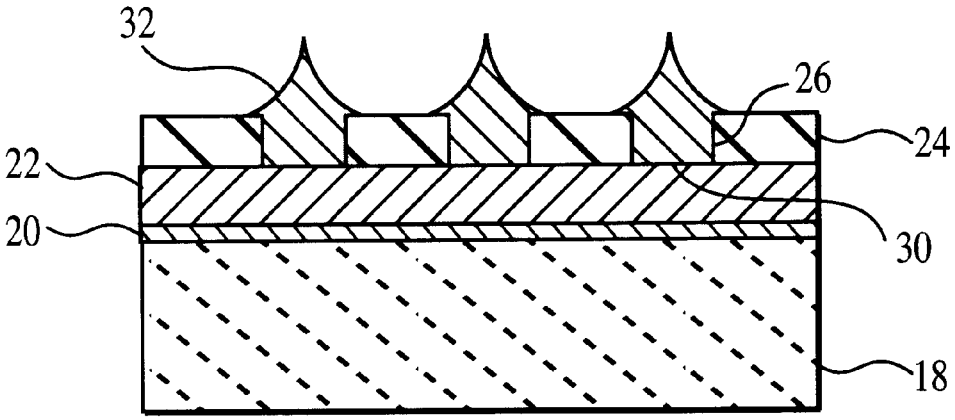
FIG. 2 illustrates a section of a field emission display substrate during a second processing step in accordance with the present invention.

Referring now to FIG. 2, the cathode material 28 is then etched to form the emitter tips 32. The layer of cathode material 28 can be etched with carbon hexa-flouride ($CF_6$). Each tip 32 has a very sharp profile and is in direct electrical contact with resistive layer 22 by a respective base 30.

Figure 3:
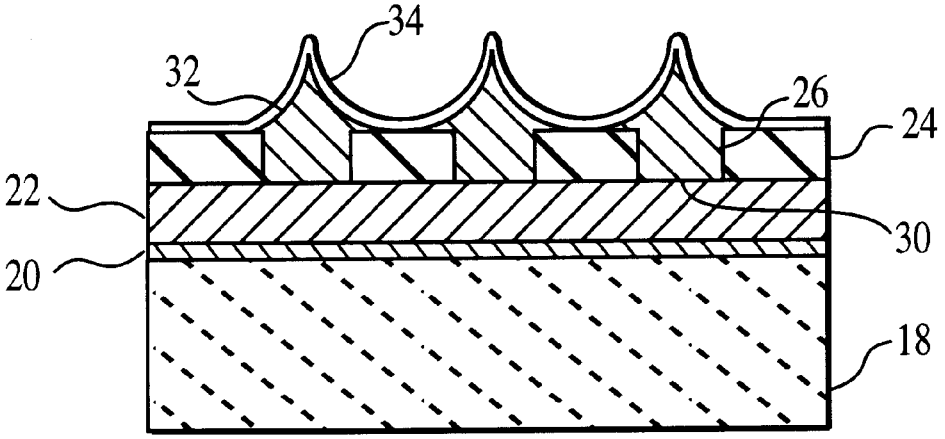
FIG. 3 illustrates a section of a field emission display substrate during a third processing step in accordance with the present invention.

With reference to FIG. 3, following the deposition of the layer of cathode material 28, an iridium (Ir) layer 34 is deposited over the tips 32. Preferably, the Ir layer 34 is provided in situ by means of Physical Vapor Deposition ("PVD"). Other depositional methods may also be used such as Chemical Vapor Deposition ("CVD"), Rapid Thermal Processing Chemical Vapor Deposition ("RTPCVD"), Low Pressure is Chemical Vapor Deposition ("LPCVD") or Molecular Beam Epitaxy ("MBE"). The Ir layer 34 is deposited to a thickness of between 50 Å and 3000 Å. Preferably, the Ir layer 34 100 Å thick to maintain the sharp profile of the tips 32.

Figure 4:
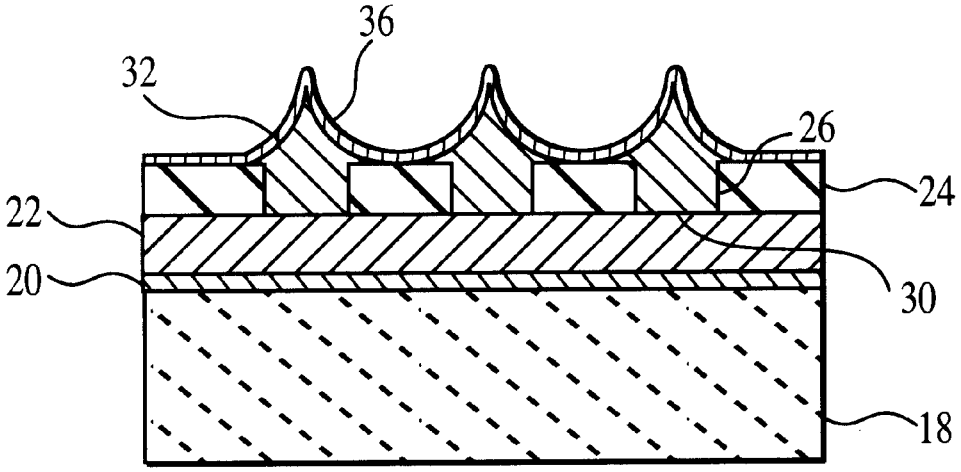
FIG. 4 illustrates a section of a field emission display substrate during a fourth processing step in accordance with the present invention.

Referring to FIG. 4, following the deposition of the Ir layer 34, an annealing step is performed to improve the metal to semiconductor contact between the tips 32 and the Ir layer 34. Preferably, annealing is performed using rapid thermal processing (RTP) with a temperature ranging anywhere from about 250° C. to about 750° C. Preferably, the temperature range used in the RTP is anywhere from 300° C. to 400° C., with 350° C. being the preferred temperature. A resulting layer of iridium silicide (IrSi) 36 is formed. The IrSi layer 36 has the same thickness as the originally deposited Ir layer 34. It must be noted that any iridium that didn't react during the annealing process would need to be stripped off from the tips 32. The unreacted iridium could be removed by a wet etching process or any other suitable method.

Because IrSi is a fine grain material which can be used to form the IrSi layer 36 as 100 Å, the resulting profile of the tips 32 after the salicidation annealing remains sharp. The sharp profile enhances electron emission from the tips 32.

Although the metal layer 34 is preferably an Ir layer, it must be noted that other metals could also be used to produce a metal silicide layer at the tips 32. For example, it is possible to use nickel (Ni), palladium (Pd) and platinum (Pt) as the layer 34. These metals, however, would require much higher temperatures during the RPT annealing to react with the Si.

Figure 5:
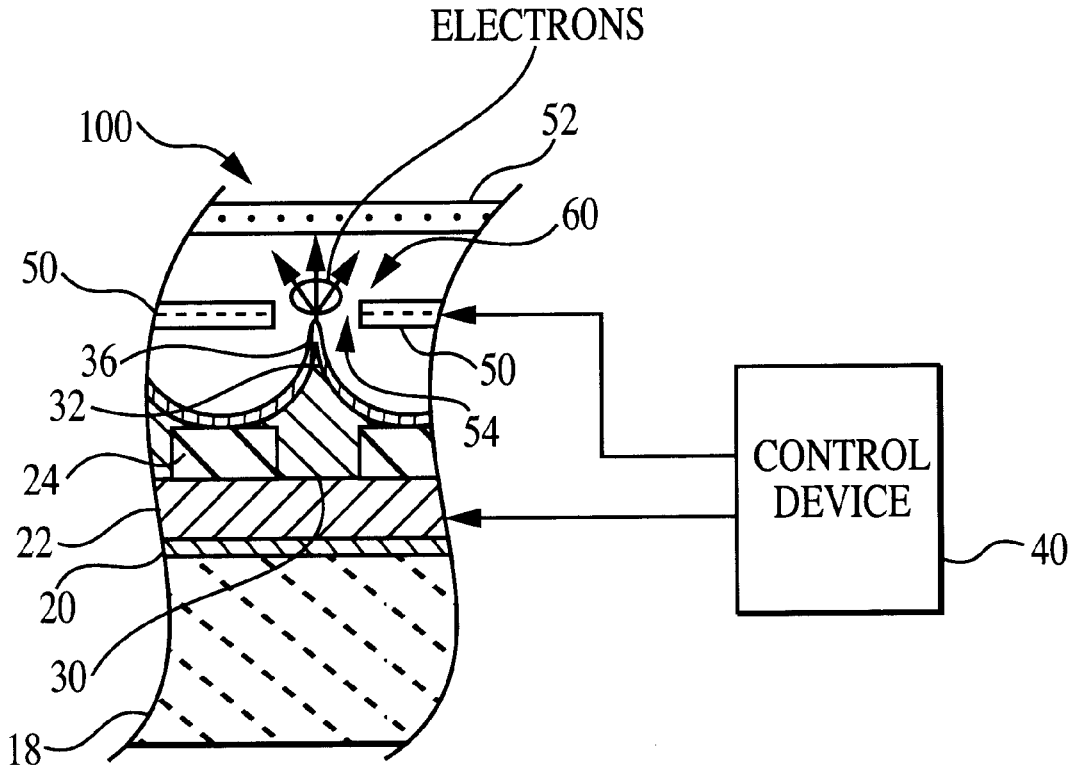
FIG. 5 illustrates a section of a field emission display utilizing emitter tips constructed in accordance with the present invention.

FIG. 5 illustrates a section of a field emission display device 100 utilizing emitter tips 32 constructed in accordance with the present invention. The device 100 includes the substrate 18, insulating layer 20, resistive layer 22, protective layer 24, cathode material 28, emitter base 30 and tips 32. The tips 32 are coated with the IrSi layer 36 or other metal silicide layer as described above with reference to FIGS. 1–4. The device 100 also includes a conductive grid 50. The grid 50 is patterned as a series of strips that will make up rows of the device 100 The grid 50 has a plurality apertures 54, each aperture 54 facing one of the tips 32. The intersection of the rows and columns will be used to activate a particular emitter tip 32 and represents a pixel to be displayed on the device 100. It must be noted that more than one emitter tip and base 32, 30 can be used per pixel if so desired. The grid 50 can reside on the protective layer 24 or on spacers depending upon the application and desirability.

A phosphor luminescent display screen 52 is positioned facing the emitter tips 32 and above the grid 50. The screen 52 may reside on spacers or other suitable devices. A vacuum 60 is created between the screen 52, grid 50 and the tips 32. The vacuum 60 can be created by any method. Once the vacuum 60 is created, a control device 40 is used to address the rows and columns (by placing an appropriate charge on the corresponding strips of the grid 50 and resistive layer 22).

In operation, the control device 40 activates a particular column and row. At the intersection of the activated row and column, a grid-to-emitter voltage differential exists which is sufficient to induce a field emission (i.e., electrons are emitted from the tips 32 through the apertures 54 and towards the screen 52). The field emission causes the illumination of the associated phosphor of the addressed pixel on the phosphorescent screen 52.

The present invention has created improved emitter tips emission tips for use in large area passive matrix cold cathode field emission flat panel display devices. By using IrSi the tips of the present invention can be formed at low temperatures. In addition, IrSi is a fine grain material that maintains a sharp profile and can be formed in a layer as thin as 100 Å.

While the invention has been described in detail in connection with the preferred embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. A method of constructing cathode tips for a cold cathode field emission display device, said method comprising:

providing a cathode material on a semiconductor substrate;

forming at least one emitter tip with a sharp profile out of the cathode material; and forming an emitting layer over each of the at least one tip, wherein the emitting layer is comprised of iridium silicide.

2. The method of claim 1 wherein the emitting layer has a thickness between 50 and 3000 angstroms.

3. The method of claim 1 wherein the emitting layer has a thickness of about 100 angstroms.

4. The method of claim 1 wherein the forming of an emitting layer comprises:

forming a layer of metal over each of the at least one tip; and annealing the layer of metal to form the metal silicide.

5. The method of claim 4 wherein said annealing is performed by a rapid thermal processing.

6. The method of claim 5 wherein the rapid thermal processing is performed in a temperature range between about 250° C. to about 750° C.

7. The method of claim 5 wherein the rapid thermal processing is performed in a temperature range between about 300° C. to about 400° C.

8. The method of claim 4 wherein the rapid thermal processing is performed in a temperature of about 350° C.

9. The method of claim 4 wherein the forming of a layer of iridium is performed by physical vapor deposition.

10. The method of claim 4 wherein the forming of a layer of iridium is performed by chemical vapor deposition.

11. The method of claim 4 wherein the forming of a layer of iridium is performed by rapid thermal processing chemical vapor deposition.

12. The method of claim 4 wherein the forming of a layer of iridium is performed by low pressure chemical vapor deposition.

13. The method of claim 4 wherein the forming of a layer of iridium is performed by molecular beam epitaxy.

14. The method of claim 1 wherein the forming of an emitting layer comprises:

forming a layer of metal over each of the at least one tip; and annealing the layer of metal to form the metal silicide.

15. A method of constructing a cold cathode field emission display device, said method comprising:

providing a first insulating layer on a semiconductor substrate;

providing a resistive layer on said first insulating layer, said resistive layer being patterned into a plurality of columns;

providing a second insulating layer on said resistive layer, said second insulating layer including at least one hole, said at least one hole reaching to a respective column of said resistive layer;

depositing cathode material on said second insulating layer and through said at least one hole in contact with said resistive layer;

providing at least one emitter tip with a sharp profile for emitting electrons formed out of said cathode material in each of said at least one hole;

forming an emitting layer over each of said at least one tip, wherein said emitting layer is comprised of iridium silicide;

providing a grid, said grid being organized into rows and having apertures aligned with said at least one tip;

providing a face plate over said emitting layer, said face plate having a display surface, said display surface including phosphors facing said at least one tip; and providing an inert gas between said face plate, said tips and said holes.

16. The method of claim 15 wherein the emitting layer has a thickness between 50 and 3000 angstroms.

17. The method of claim 15 wherein the emitting layer has a thickness of about 100 angstroms.

18. The method of claim 15 wherein the forming of an emitting layer comprises:

forming a layer of iridium on the tips; and annealing the iridium to form iridium silicide.

19. The method of claim 18 wherein said annealing is performed by a rapid thermal processing.

20. The method of claim 19 wherein the rapid thermal processing is performed in a temperature range between about 250° C. to about 750° C.

21. The method of claim 19 wherein the rapid thermal processing is performed in a temperature range between about 300° C. to about 400° C.

22. The method of claim 19 wherein the rapid thermal processing is performed in a temperature of about 350° C.

23. The method of claim 18 wherein the forming of a layer of iridium is performed by physical vapor deposition.

24. The method of claim 18 wherein the forming of a layer of iridium is performed by chemical vapor deposition.

25. The method of claim 18 wherein the forming of a layer of iridium is performed by rapid thermal processing hemical vapor deposition.

26. The method of claim 18 wherein the forming of a layer of iridium is performed by low pressure chemical vapor deposition.

27. The method of claim 18 wherein the forming of a layer of iridium is performed by molecular beam epitaxy.

28. The method of claim 15 wherein the forming of an emmitting layer comprises:

forming a layer of metal over each of the at least one tip; and annealing the layer of metal to form the metal silicide.

* * * * *

UNITED STATES PATENT AND TRADEMARK OFFICE

CERTIFICATE OF CORRECTION

PATENT NO. : 6,328,620 B1
DATED : December 11, 2001
INVENTOR(S) : Yongjun J. Hu

It is certified that error appears in the above-identified patent and that said Letters Patent is hereby corrected as shown below:

Column 1,
Lines 55 and 59, “face plate” should read -- faceplate --.

Column 2,
Line 1, “face plate” should read -- faceplate --.

Column 5,
Line 3, “metal over each of the at least one tip” should read -- iridium on the tips --.
Line 5, “layer of metal” should read -- iridium --.

Column 6,
Line 23, “providing a face plate over said emitting layer, said face” should read -- providing a faceplate over said emitting layer, said faceplate --.
Line 24, “plate” should be canceled.
Line 26, “face plate” should read -- faceplate --.

Signed and Sealed this

Second Day of July, 2002

*Attest:*

*Attesting Officer*

JAMES E. ROGAN
*Director of the United States Patent and Trademark Office*